US007525491B2

(12) United States Patent
Hu et al.

(10) Patent No.: US 7,525,491 B2
(45) Date of Patent: Apr. 28, 2009

(54) ANTENNA FOR ELECTRONIC PRODUCT AND METHOD FOR FABRICATING THE SAME

(75) Inventors: Tseng-Hsiang Hu, Tu-Cheng (TW); Li-Kuang Tan, Tu-Cheng (TW); Yeu-Lih Lin, Tu-Cheng (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 83 days.

(21) Appl. No.: 11/690,043

(22) Filed: Mar. 22, 2007

(65) Prior Publication Data

US 2008/0191948 A1 Aug. 14, 2008

(30) Foreign Application Priority Data

Jan. 19, 2007 (CN) ..... 2007 1 0073005

(51) Int. Cl.
*H01Q 1/24* (2006.01)

(52) U.S. Cl. ..... 343/702; 343/700 MS; 343/895; 343/872

(58) Field of Classification Search ..... 343/702, 343/700 MS, 895, 872
See application file for complete search history.

(56) References Cited

U.S. PATENT DOCUMENTS

| | | | | |
|---|---|---|---|---|
| 6,919,843 | B2 | 7/2005 | Tsai et al. | |
| 7,091,910 | B2 * | 8/2006 | Liang et al. | 343/702 |
| 7,106,260 | B2 * | 9/2006 | Ryu et al. | 343/702 |
| 2002/0000940 | A1 * | 1/2002 | Moren et al. | 343/702 |
| 2003/0016178 | A1 * | 1/2003 | Byun et al. | 343/702 |
| 2007/0216580 | A1 * | 9/2007 | Lin et al. | 343/702 |

* cited by examiner

*Primary Examiner*—Hoang V Nguyen
(74) *Attorney, Agent, or Firm*—Frank R. Niranjan

(57) ABSTRACT

An antenna device (10) of a consumer electronic product is formed on an outer surface (302) of a shell (30) of the electronic product. The shell of the consumer electronic product is adapted for forming an enclosure of an electronic product. The antenna device extends on a planar plane and is integrally formed with and is coated on the outer surface of the shell. A method for making the antenna device includes: (A) providing a consumer electronic product having a shell for forming the antenna device on an outer surface thereof, the shell being adapted for enclosing components of the consumer electronic product therein; (B) coating a copper layer on the outer surface of the shell of the electronic product; (C) forming circuitry out of the copper layer to form the antenna device.

19 Claims, 6 Drawing Sheets

ANTENNA FOR ELECTRONIC PRODUCT AND METHOD FOR FABRICATING THE SAME

BACKGROUND OF THE INVENTION

1. Field of the Invention

The present invention relates generally to antenna devices, and more particularly to an antenna device used as a frequency transceiver antenna provided in a consumer electronic product.

2. Description of Related Art

Consumer electronic products, such as mobile phones, have become increasingly developed, aiming for the smaller size, lighter weight, multi functions, and lower power consumption. An antenna, one of essential components of the mobile phone, is a crucial factor for determining communication quality.

An example of an antenna typically used in mobile phones is an exposed coil. Under normal circumstances, the antenna still protrudes a specific length out of the body's top surface of the mobile phone. The conventional coil antennas are thus unsuitable for use in miniaturized mobile phones; hence, microstrip antennas which are flat and small have been developed. However these antennas require the installation of spiral antenna elements on separate ground boards, and the insertion of dielectric and loading material of specific thickness between them. It is thus difficult to reduce the size of the antenna. Furthermore, since these microstrip antennas are mounted inside the mobile phones, reception and transmission of signals by these micorstrip antennas cannot have an optimal quality due to obstruction of other components around the microstrip antennas.

Therefore, it is desirable to provide an antenna device wherein one or more of the foregoing disadvantages may be overcome or at least alleviated.

SUMMARY OF THE INVENTION

The present invention relates, in one aspect, to an antenna device of a consumer electronic product. The consumer electronic product has a shell being adapted for forming an enclosure of an electronic product. The shell has an outer surface. The antenna device extends on a planar plane and is integrally formed with and coated on the outer surface of the shell.

The present invention relates, in another aspect, to a method for fabricating the antenna device. The method includes: (A) providing a consumer electronic product having a shell for forming the antenna device on an outer surface thereof, the shell being adapted for enclosing components of the consumer electronic product therein; (B) coating a copper layer on the outer surface of the shell of the electronic product; (C) forming circuitry out of the copper layer to form the antenna device.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present antenna device can be better understood with reference to the following drawings. The components in the drawings are not necessarily drawn to scale, the emphasis instead being placed upon clearly illustrating the principles of the present antenna device. Moreover, in the drawings, like reference numerals designate corresponding parts throughout the several views.

DETAILED DESCRIPTION OF THE INVENTION

Figure 1:
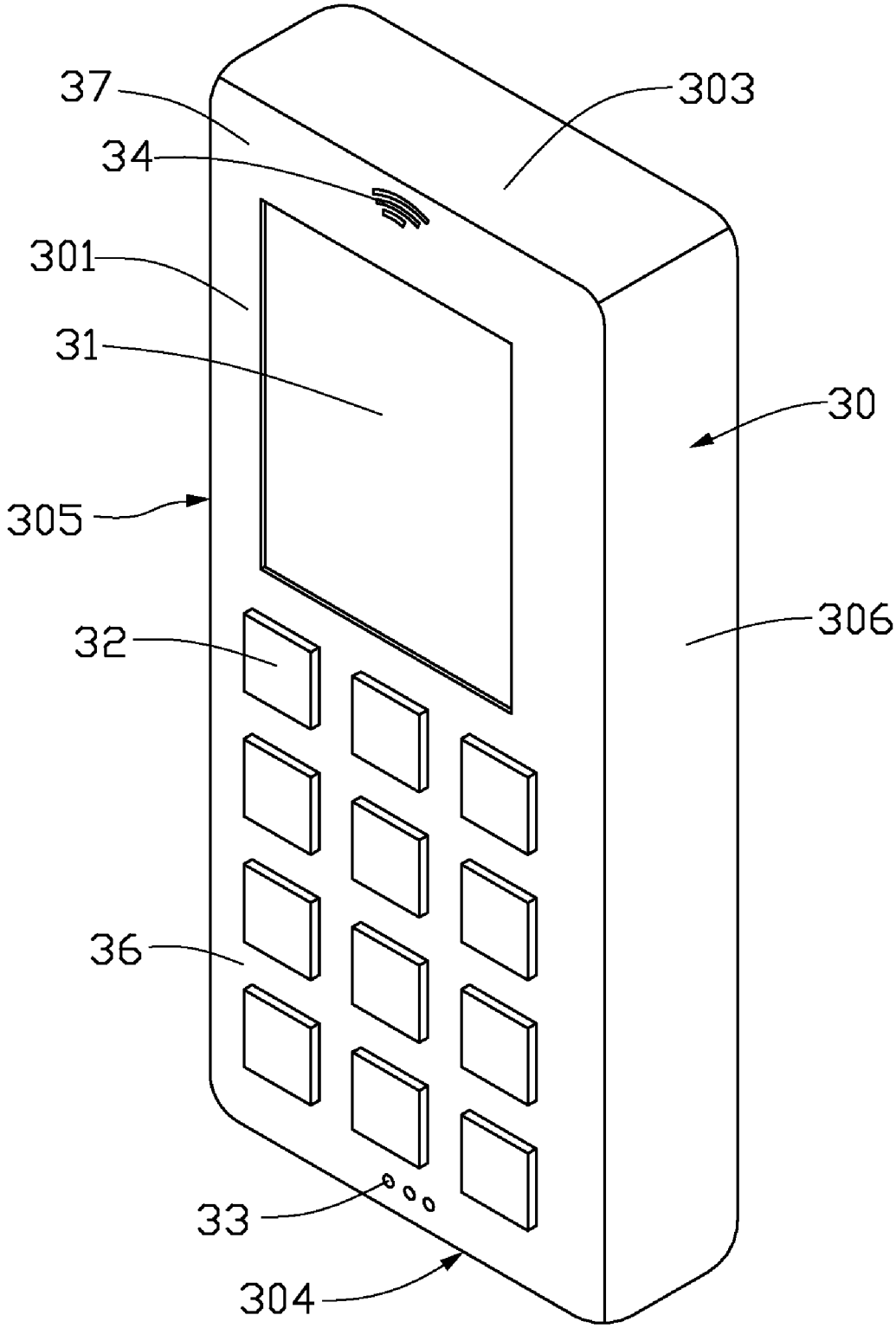
FIG. 1 is an assembled, isometric view of a mobile phone with an antenna device in accordance with a first embodiment of the present invention.
Figure 2:
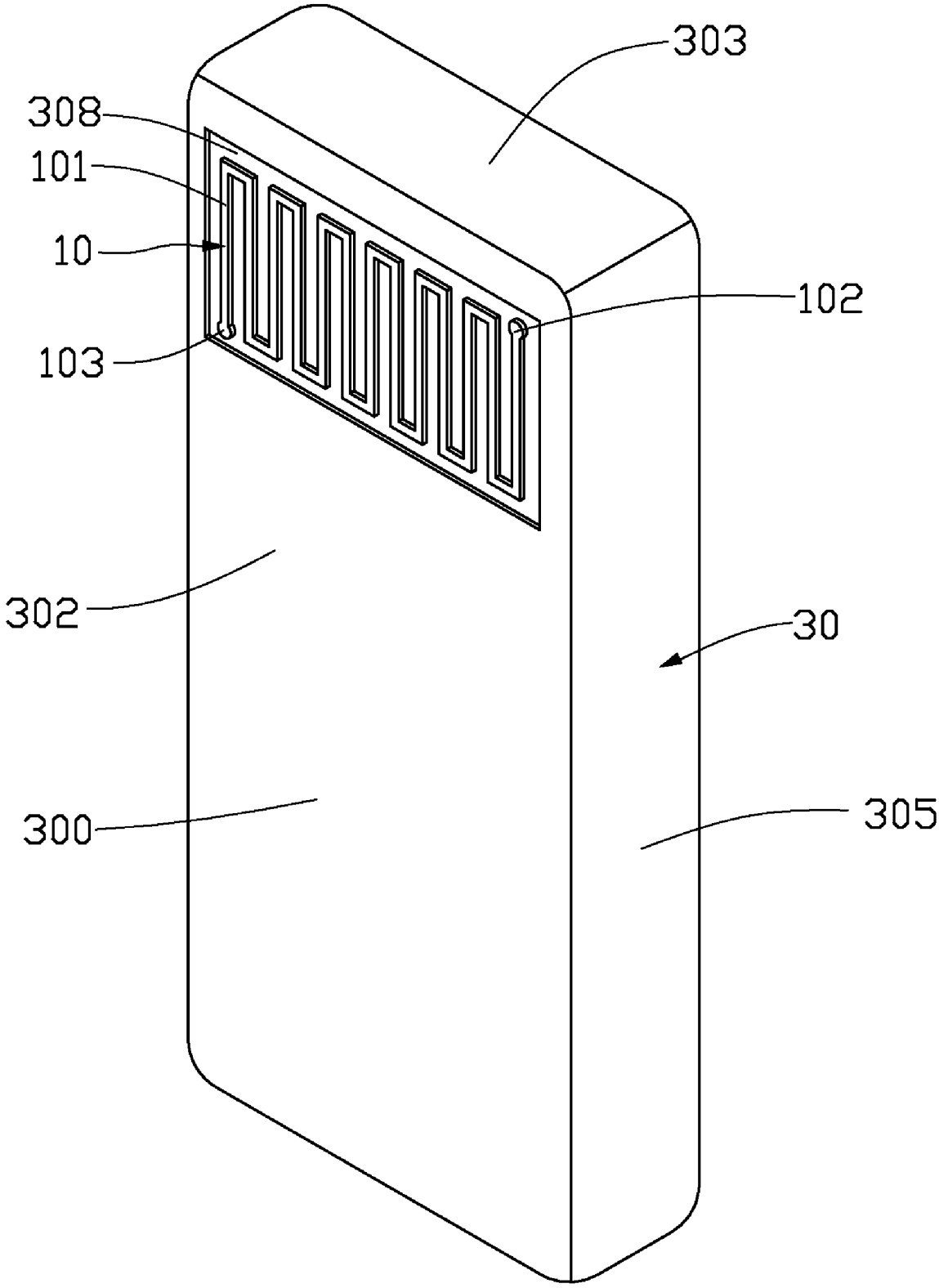
FIG. 2 is similar to FIG. 1, but viewed from another aspect.

FIGS. 1 and 2 illustrate a mobile phone with an antenna device 10 in accordance with a first embodiment of the present invention. Also the antenna device 10 can be used as a frequency transceiver antenna of other consumer electronic products, such as PDAs (Personal Digital Assistants), cordless telephones, interphones, notebook computers, desktop computers or wireless handheld devices. In this embodiment, the mobile phone has a cuboid-shaped shell 30 defining an inner space (not shown) therein for receiving electronic components, such as switching circuits (not shown) which are used to obtain signal conversion. The shell 30 is made of Mg—Al alloy (magnesium-aluminum alloy), and includes a front wall 301, and a back wall 302 parallel to the front wall 301. A top side wall 303, a bottom side wall 304, a left side wall 305, and a right side wall 306 interconnecting four sides (i.e., top, bottom, left and right sides) of the front wall 301 and the back wall 302, respectively. Each wall of the shell 30 is rectangle shaped. The six walls cooperatively form the cuboid-shaped shell 30. The front wall 301 of the shell 30 forms an output section 37 near the top side thereof, a display section 31 in a middle thereof, and an input section 36 near a bottom side thereof. The input section 36 has a microphone 33 and a plurality of keys 32 or a touch panel (not shown) for inputting signals. The output section 37 of the mobile phone can contain a speaker 34 which can transform electric signals into mechanical vibrations so as to transmit acoustic messages therein.

Particularly referring to FIG. 2, the antenna device 10 is directly and integrally formed on the back wall 302 of the shell 30 and is located near the top side of the shell 30. The antenna device 10 is a rectangular wave-shaped electronic circuitry 101. The electronic circuitry 101 is made of copper. The back wall 302 of the shell 30 defines a concave 308 in an outer surface 300 thereof corresponding to the electronic circuitry 101. The concave 308 is rectangle-shaped. A depth of the concave 308 is approximately the same or a little larger than a height of the electronic circuitry 101. The electronic circuitry 101 is received in the concave 308 and is not higher than the concave 308 of the shell 30 and thus abrasion of the antenna device 10 by a foreign article is avoided. In this embodiment, the electronic circuitry 101 has a rectangular wave (i.e., crenellated) shape. Alternatively, the shape of the electronic circuitry 101 is variable, and can be other wave shapes, such as sine wave shape, sawtooth wave, pulsating wave shape, longitudinal wave shape, etc. Also the antenna device 10 is not limited to being wave-shaped, other shapes, like linear shaped or slice shaped can also be suitable. For enhancing aesthetic appearance of the mobile phone, the antenna device 10 can be formed as the trademark of the product, or to be formed as a part of the trademark. One end (right, top end as viewed from FIG. 2) of the electronic circuitry 101 forms an input terminal 102 which is electrically connected with a signal processing circuit of the mobile phone. The other end (left, lower end) of the electronic circuitry 101 is an earth terminal 103 and is electrically connected with the ground. A through hole (not shown) can be defined in the back wall 302 of the shell 30 corresponding to each of the terminals 102, 103 of the electronic circuitry 101. Wire cables extend through the through holes and interconnect the electronic circuitry 101 and the switching circuits and the ground. Alternatively, the electronic circuitry 101 can be connected with the switching circuits and the ground through spot welding.

During operation of the mobile phone, the input terminal 102 receives or outputs electromagnetic signals. The switching circuits being electrically connected with the antenna device 10 is used to transform the electromagnetic signals. Since the antenna device 10 is integrally formed on the back wall 302 of the shell 30, the antenna device 10 no longer occupies a protruded space, which is suitable for the design requirement of the miniaturized mobile phones. Furthermore, as the antenna device 10 is formed outside the shell 30, the effective of receiving and outputting signals is improved, resulting in better communication quality, including sound, words and pictures.

Figure 3:
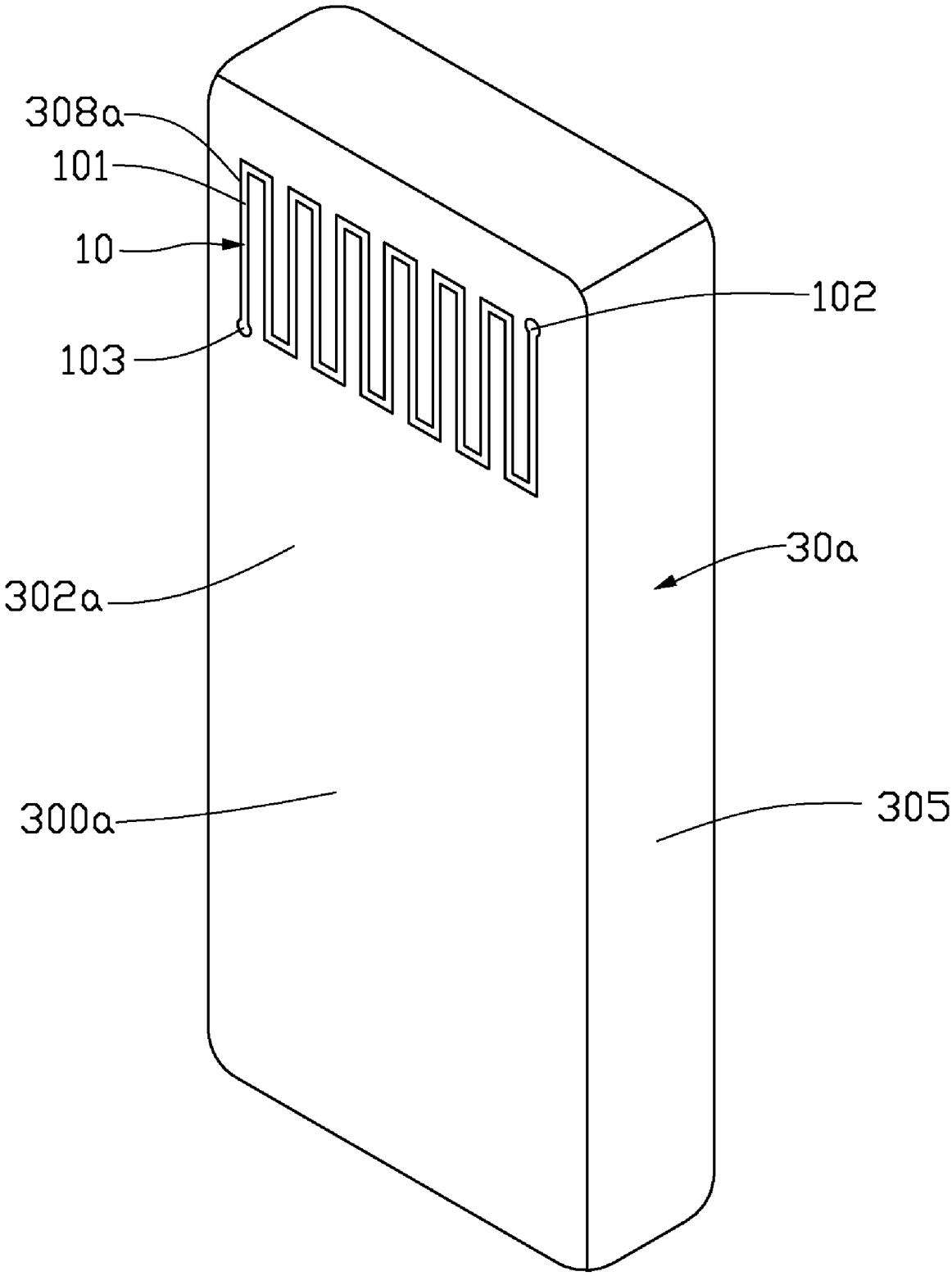
FIG. 3 is similar to FIG. 2, but shows the antenna device in accordance with a second embodiment of the present invention.

FIG. 3 illustrates a second embodiment of the antenna device 10. The difference between the second embodiment and the first embodiment is that the concave section 308*a* defined in the back wall 302*a* of the shell 30*a* has a shape and size essentially identical to that of the antenna device 10. The antenna device 10 consists of a rectangular wave-shaped electronic circuitry 101. The concave section 308*a* is a rectangular wave-shaped groove. The antenna device 10 is formed in the concave section 308*a* and thus the concave section 308*a* is essentially filled. Cooperatively the back wall 302*a* and the antenna device 10 construct an integrated and planar-shaped outer surface 300*a*.

Figure 4:
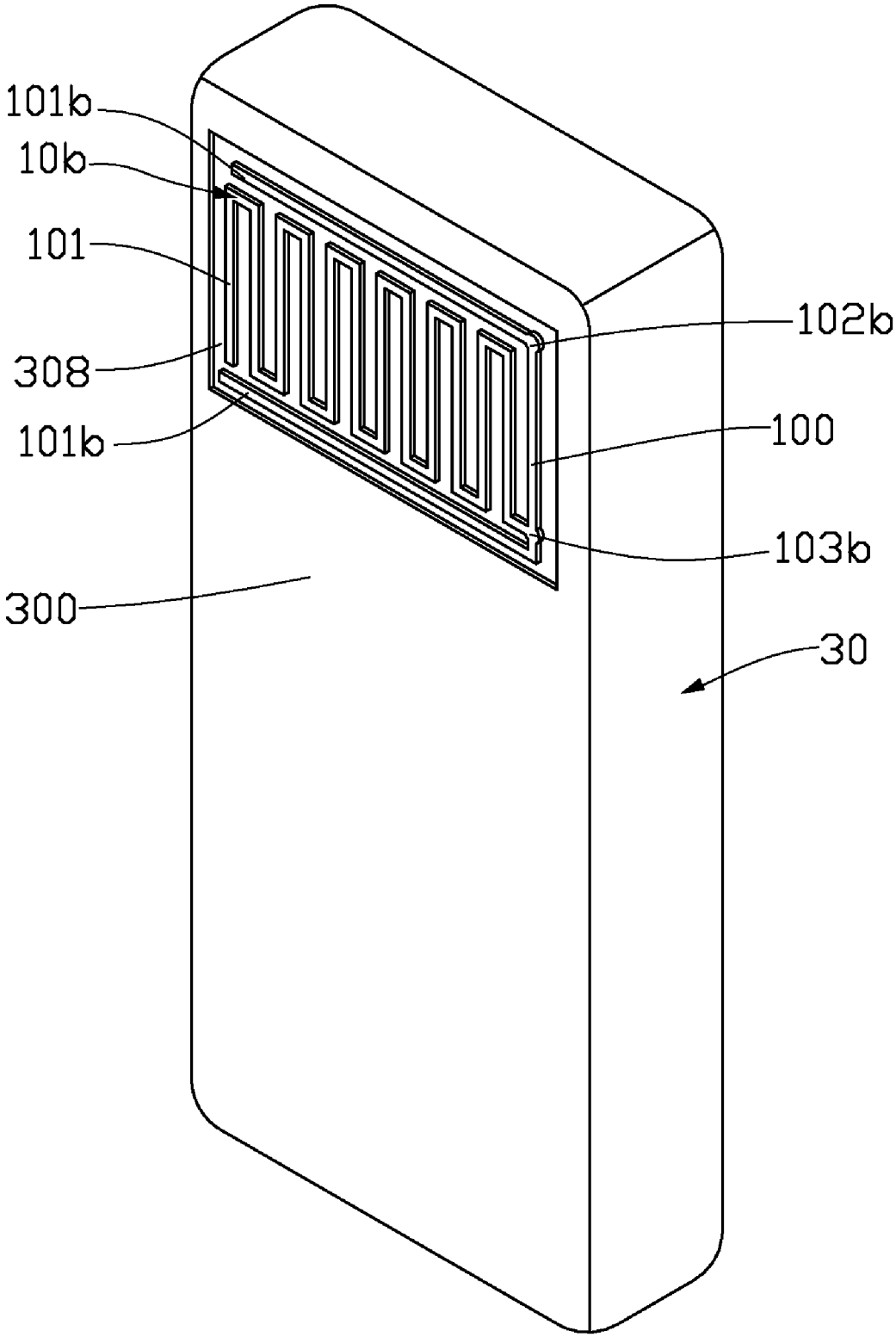
FIG. 4 shows the antenna device in accordance with a third embodiment of the present invention.

FIG. 4 shows the third embodiment of the antenna device 10*b* which has several electronic circuit segments interconnected together. As shown in FIG. 4, the antenna device 10*b* includes a rectangular wave-shaped circuitry 101, two horizontally extended linear-shaped circuit segments 101*b* and a vertically extended linear-shaped circuit segment 100. The circuit segment 100 is located at a right side of the antenna device 10*b* as viewed from FIG. 4. The two linear-shaped circuit segments 101*b* extend transversely above and below the rectangular wave-shaped circuitry 101 and are parallel to each other. The right ends of the three circuit segments 101, 101*b* as viewed from FIG. 4 are connected together by the right vertical circuit segment 100, whilst the left ends of the three segments 101, 101*b* are separated from each other. A junction of the upper horizontal circuitry segment 101*b* and the right vertical circuitry segment 100 forms the input terminal 102*b*. A junction of a lower, right end of the rectangular wave-shaped circuitry 101 and the right vertical circuit segment 100 forms the ground terminal 103*b*.

Figure 5:
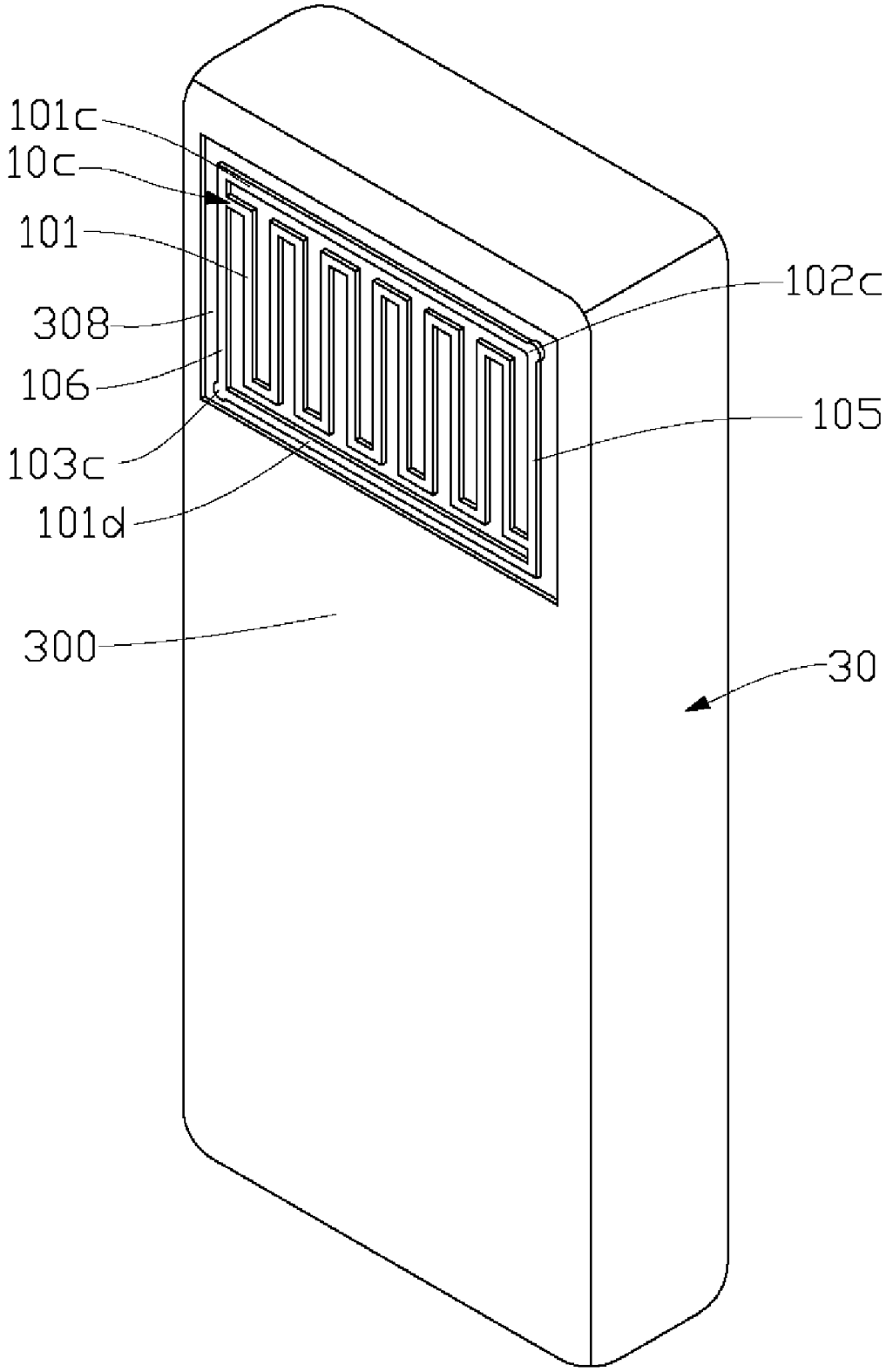
FIG. 5 shows the antenna device in accordance with a fourth embodiment of the present invention.

As shown in FIG. 5, the antenna device 10*c* in accordance with the fourth embodiment of the present invention is similar to the third embodiment. In this embodiment, the antenna device 10*c* includes five circuit segments, which include a rectangular wave-shaped circuitry 101, two horizontally extended linear-shaped circuit segments 101*c*, 101*d* and two vertically extended linear-shaped circuit segments 105, 106. The right ends of the three circuit segments 101, 101*c*, 101*d* are connected together by the right vertical circuit segment 105. The left ends of the three circuit segments 101, 101*c*, 101*d* are connected together by the left vertical circuit segment 106. The input terminal 102*c* is formed at a junction of the right end of the circuit segment 101*c* and a top end of the right vertical circuit segment 105. The ground terminal 103*c* is formed at a junction of the left end of the circuit segment 101*d* and a bottom end of the left vertical circuit segment 106.

Figure 6:
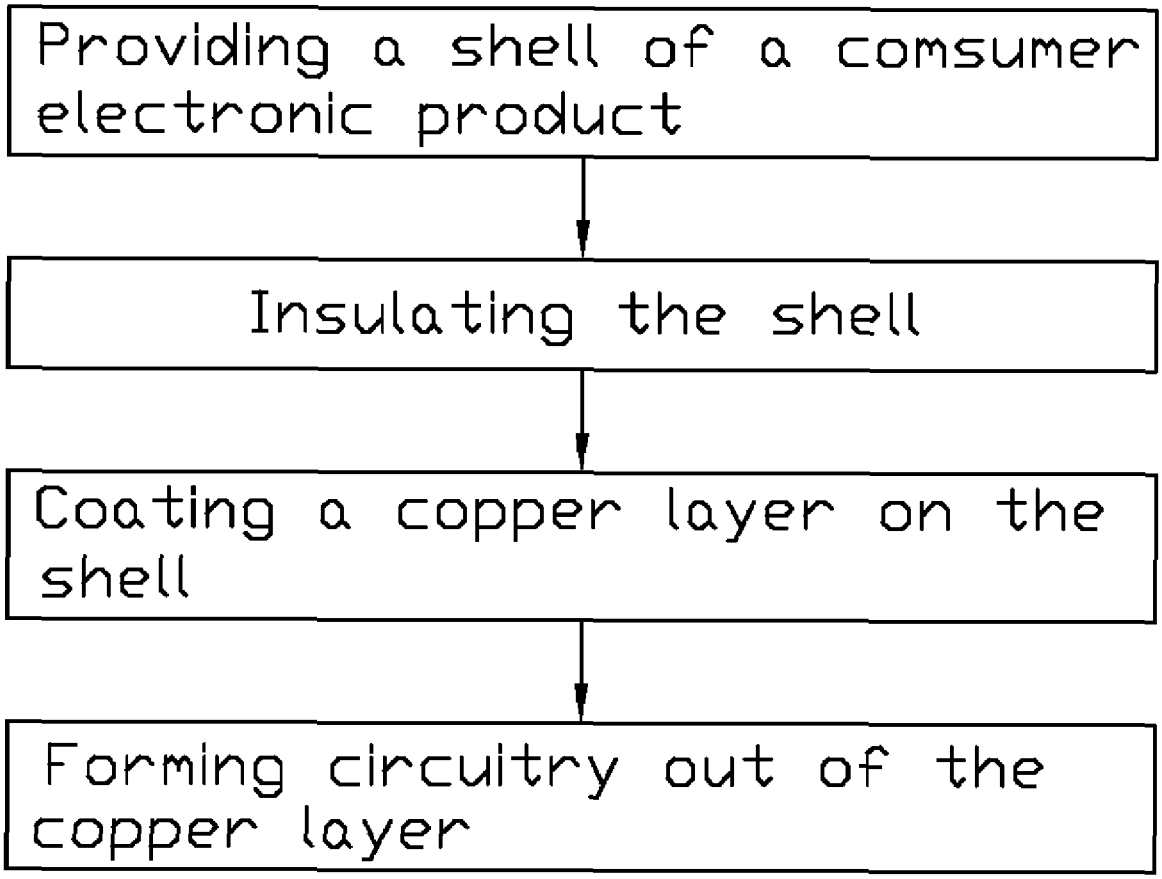
FIG. 6 is a flow chart showing a preferred method of making the antenna device.

FIG. 6 shows a preferred method in accordance with the present invention for producing the antenna device 10, 10*b*, 10*c*. Firstly, an electronic device, such as a mobile phone, a PDA, a cordless telephone, or an interphone is provided. In this embodiment, the consumer electronic product is the mobile phone as shown in FIGS. 1-2. The consumer electronic product has a shell 30 forming a back wall 302. A concave 308 is defined in an outer surface 300 of the back wall 302. The concave 308 is rectangle-shaped. The back wall 302 defines a planar-shaped bottom surface (not labeled) in the concave 308. Then a very thin insulating layer is formed on the bottom surface in the concave 308 through vacuum sputtering, vaporization or anodizing. For firmly attaching the insulating layer to the bottom surface, the bottom surface is previously processed with cleaning, caustic scrubbing or burring.

The electronic circuitry 101 is then formed on the insulating layer on the bottom surface in the concave 308 of the shell 30 by the following steps. Firstly, a thin layer of copper foil is applied onto the insulating layer of the bottom surface so as to evenly cover the insulating layer. The copper foil layer can be formed on the insulating layer through sputtering, hot-pressing, electroless copper deposition, or electrodeposition. As material does not easily adhere to the insulating layer, surface activation of the insulating layer is usually needed before forming the copper foil layer on the insulating layer. The surface activation usually includes silver spraying, sandblasting, and coursing. Thus the copper foil layer is easily applied to the insulating layer after surface activation. Then the electronic circuitry 101 is formed on the insulating layer by the copper foil layer through photoresist coating, exposing and etching.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna device comprising:

a shell having an outer surface, the shell being adapted for forming an enclosure of an electronic product; and an antenna extending on a planar plane and being integrally formed with and coated on the outer surface of the shell, one end of the antenna forming a signal input/output terminal adapted for electronically connecting with a signal processing circuit of the electronic product, and another end of the antenna being a ground terminal adapted for being electrically connected with ground.

2. The antenna device of claim 1, wherein the antenna is wave-shaped.

3. The antenna device of claim 2, wherein the antenna has one of the following shapes: rectangular wave, sine wave shape, sawtooth wave, pulsating wave shape, and longitudinal wave shape.

4. The antenna device of claim 2, wherein the antenna forms a trademark for the electronic product.

5. The antenna device of claim 1, wherein the antenna comprises a plurality of circuit segments interconnected together to form a plurality of junctions, and the junctions form the signal input/output terminal and the ground terminal.

6. The antenna device of claim 1, wherein the antenna is made of copper.

7. The antenna device of claim 1, wherein the electronic product is one of the following products: mobile phones, PDAs, cordless telephones, interphones, notebook computers, desktop computers and wireless handheld devices.

8. The antenna device of claim 1, wherein the electronic product is a mobile phone, and the antenna is formed on an outer surface of a back wall of the shell of the mobile phone and is located near a top side of the mobile phone.

9. The antenna device of claim 1, wherein the shell defines a concave receiving the antenna therein.

10. The antenna device of claim 9, wherein the concave has a shape and size the same as that of the antenna.

11. A method for making an antenna device of consumer electronic products, comprising:

providing a consumer electronic product having a metal shell for forming the antenna device on an outer surface thereof, the metal shell being adapted for enclosing components of the consumer electronic product therein;

forming an insulating layer on the outer surface of the metal shell;

coating a copper layer on the insulating layer; and forming circuitry out of the copper layer to form the antenna device.

12. The method of claim 11, wherein the metal shell is made of Mg—Al alloy, and the insulating layer is formed through one of the following methods: vacuum sputtering, vaporization and anodizing.

13. The method of claim 12, wherein the circuitry is formed on the insulating layer by firstly covering the insulating layer with a copper foil layer thereon through one of the following methods: sputtering, hot-press, electroless copper deposition and electrodeposition, and then photoresist coating, exposing and etching the copper foil layer.

14. The method of claim 11, further comprising a step of surface activation before coating the copper layer, the surface activation being one of the following methods: silver spraying, sandblast, and coursing.

15. The method of claim 11, further comprising a step of forming a concave in the metal shell before forming the insulating layer, and the insulating layer is formed in the concave.

16. An electronic product comprising:

a metal shell adapted for enclosing components of the electronic product therein, the metal shell having an outer surface defining a concave therein, the concave having a bottom surface;

an insulating layer being coated on the bottom surface; and an antenna being coated on the bottom surface for receiving and transmitting wireless signal.

17. The electronic product of claim 16, wherein the antenna forms a part of a trademark of the electronic product.

18. The electronic product of claim 16, wherein the antenna has a wave-like configuration.

19. The electronic product of claim 16 further comprising an input section for inputting data into the electronic product, wherein the input section is located at a front surface of the shell and the antenna is located at a rear surface of the shell.

* * * * *